United States Patent [19]

Lux née Andrieux

[11] Patent Number: 4,847,124

[45] Date of Patent: Jul. 11, 1989

[54] ARTICLE ADAPTED TO CONTAIN A SAMPLE OF A FRAGRANT SUBSTANCE

[76] Inventor: Colette S. Lux née Andrieux, 3 rue de Chataigniers, 9219Q Meudon, France

[21] Appl. No.: 206,762

[22] Filed: Jun. 15, 1988

[30] Foreign Application Priority Data

Jun. 30, 1987 [FR] France ..... 87 09251

[51] Int. Cl.[4] ..... A61L 9/04

[52] U.S. Cl. ..... 428/34.2; 156/70; 239/34; 428/101; 428/321.5; 428/905

[58] Field of Search ..... 156/70; 239/34; 428/101, 321.5, 905, 34.2; 524/700

[56] References Cited

U.S. PATENT DOCUMENTS

| | | | |
|---|---|---|---|
| 1,634,136 | 6/1927 | Clark | 428/101 X |
| 2,732,065 | 1/1956 | Marchese | 428/78 X |
| 3,065,915 | 11/1962 | Samann | 428/905 X |
| 3,441,353 | 4/1969 | Claff | 428/79 X |
| 3,494,505 | 2/1970 | Huebner et al. | 428/905 X |
| 3,516,941 | 6/1970 | Matson | 524/700 X |
| 3,599,859 | 8/1971 | Maierson | 239/34 X |
| 3,623,659 | 11/1971 | Maierson et al. | 428/905 X |
| 4,145,001 | 3/1979 | Weyenberg et al. | 428/905 X |
| 4,186,743 | 2/1980 | Steiger | 428/905 X |
| 4,487,801 | 12/1984 | Turnbull et al. | 428/323 X |
| 4,520,142 | 5/1985 | Leinen | 524/903 X |
| 4,528,226 | 7/1985 | Sweeny | 428/905 X |
| 4,661,388 | 4/1987 | Charbonneau | 428/323 X |
| 4,720,417 | 1/1988 | Sweeny et al. | 428/321.5 X |
| 4,720,423 | 1/1988 | Fraser | 428/323 X |
| 4,774,971 | 10/1988 | Vieten | 428/905 X |

FOREIGN PATENT DOCUMENTS

| | | | |
|---|---|---|---|
| 2012563 | 3/1970 | France | 428/905 |

*Primary Examiner*—Henry F. Epstein

*Attorney, Agent, or Firm*—Fisher, Christen & Sabol

[57] ABSTRACT

This invention relates to an article adapted to contain at least one sample of a fragrant substance releasable by friction, of the type constituted by an adhesive film in which are incorporated a plurality of micro-capsules containing said substance. According to the invention, the article comprises, on the one hand, a tongue of which one of the faces presents such an adhesive film, and, on the other hand, a surface capable of coming into contact with said film, said tongue and said surface being adapted to be displaced with respect to each other so that, during their relative displacement, the friction created therebetween destroys said micro-capsules and diffuses said fragrant substance. The article is particularly employed for advertising and commercial purposes and in the perfume industry.

5 Claims, 1 Drawing Sheet

ARTICLE ADAPTED TO CONTAIN A SAMPLE OF A FRAGRANT SUBSTANCE

BACKGROUND OF THE INVENTION

1. Field of the Invention

The present invention relates to an article adapted to contain at least one sample of a fragrant substance, such as for example a perfume, releasable by friction.

2. Background Art

The commercial article according to the invention may be intended for various uses, for example for advertising purposes, to promote before the general public the launching of a new perfume or to stimulate sales of a product recalling a specific perfume. The use of said article may also be appreciated by professionals in the perfume industry where each article may contain a specific fragrant substance such as a determined natural essence, a composition of a perfume, or the like.

Such an article of the type used for advertising is already known, constituted by a support, generally paper, on one face of which is disposed an adhesive film in which are incorporated a plurality of micro-capsules containing a fragrant substance. The perfume is released by the consumer scratching the film with his/her finger nail or an object. During the scratching operation, the micro-capsules are destroyed, thus diffusing the perfume that they contain. Although the article is attractive from the advertising standpoint, the necessity of scratching the adhesive film with the finger nail to bring out the perfume tarnishes its image, since, on the one hand, part of the torn off film remains under the consumer's finger nail, and, on the other hand, his/her hand is impregnated with the perfume diffused when the micro-capsules are destroyed, which may be appreciated by a consumer enjoying the perfume diffused, but certainly not in the contrary case. Such an article is consequently unsuitable in the above-mentioned application as far as professionals in the perfume industry are concerned.

Moreover, the presentation of this article is hardly aesthetic, since it is simply a paper support having no originality.

BROAD DESCRIPTION OF THE INVENTION

It is an object of the present invention to overcome these drawbacks by providing an article bearing a fragrant substance releasable by friction, which avoids the scratching operation and which avoids said fragrant substance impregnating the consumer's hand.

To that end, the article according to the invention, adapted to contain at least one sample of a fragrant substance releasable by friction, of the type constituted by an adhesive film in which are incorporated a plurality of micro-capsules containing said substance and adapted to be destroyed by pressure, is noteworthy in that it comprises, on the one hand, a tongue or the like of which at least one of the faces presents at least one such adhesive film, and, on the other hand, a surface capable of coming into contact with said film, said tongue and said surface being adapted to be displaced with respect to each other so that, during their relative displacement, the friction created therebetween destroys said micro-capsules and diffuses said fragrant substance.

In a preferred embodiment, said tongue is removably housed in a case of which one of the sides, capable of coming into contact with said face of the tongue presenting said film, defines said surface.

One end of said tongue advantageously emerges from said case, allowing said tongue to be accessible from the outside. Moreover, said emerging end is not coated with said film containing the micro-capsules. In this way, the consumer's hands are not in direct contact with the fragrant substance, since he/she acts, on the one hand, on the outer sides of said case and, on the other hand, on the non-coated emerging end of the tongue. When the consumer has extracted the latter from said case, of which the friction with respect to each other has released the fragrant substance, he takes said tongue to his nose in the same way as a perfume expert does when he identifies an essence or a perfumed composition. Consequently, the article according to the invention is also intended for professionals in the perfume industry, where each of the articles may contain a specific fragrant substance.

According to a further feature of the invention, said side of said case, adapted to come into contact with the coated face of the tongue, may comprise scratching means. In this way, the micro-capsules are not only torn by the friction created during the displacement of the tongue from said case, but also by the scratching means.

In a preferred embodiment, said scratching means are constituted by an adhesive film deposited on said side and containing abrasive particles, with the result that, during the displacement of the tongue out of said case, the abrasive particles tear the perfumed micro-capsules.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
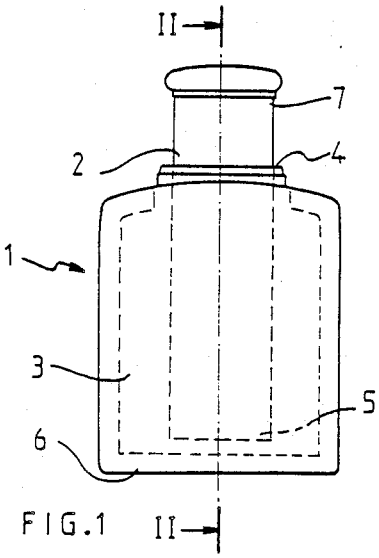
FIG. 1 shows, in front view, a preferred embodiment of said article according to the invention, before it is used.
Figure 2:
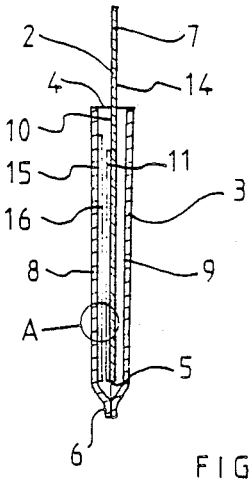
FIG. 2 is a view in section of the article along line II—II of FIG. 1.

Referring now to the drawings, and firstly to FIGS. 1 and 2, the article 1 bearing a fragrant substance, in the present case a perfume releasable by friction, comprises according to the invention a flat, elongated, removable tongue 2 housed for the major part in a substantially flat case 3, which presents an opening 4 in its upper part for passage of the tongue 2.

Figure 5:
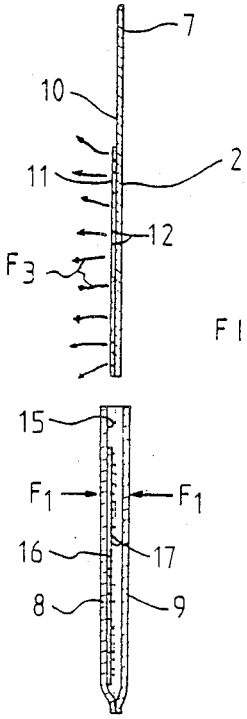
FIG. 5 is a view in section of the article along line V—V of FIG. 4.

The lower end 5 of said tongue lies in the vicinity of the bottom 6 of the case 3 whilst its upper end 7 emerges from the case constituted by two sides 8 and 9. The thickness of these latter as well as that of the tongue have been exaggerated in FIGS. 2 and 5.

As shown in FIG. 1, the article 1 advantageously presents an outer shape aesthetically similar to that of a bottle containing a perfume. The emerging upper end 7 thus presents the form of a stopper.

According to the invention, one of the faces of the tongue 2, for example face 10, is coated on the part thereof adapted to be housed in the case 3 and therefore not at the emerging end 7, with an adhesive film 11 in which are incorporated a plurality of micro-capsules 12 which contain a perfume. The other face 14 of the tongue 2 may also be coated with such a film.

Figure 3:
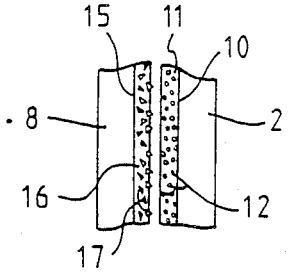
FIG. 3 illustrates on a larger scale the detail A of FIG. 2.

Moreover, side 8 presents, on its inner face 15, facing face 11 of the tongue 2, scratching means constituted for example by an adhesive film 16 deposited on the inner face 15 and which contains a plurality of abrasive particles 17. FIG. 3 illustrates on a larger scale this particular embodiment, although, in another variant embodiment, such scratching means are not indispensable for releasing the perfume proper contained in the micro-capsules, as specified hereinabove.

Figure 4:
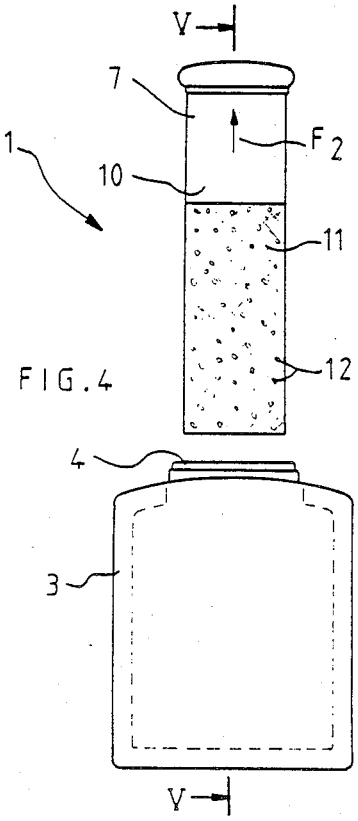
FIG. 4 shows, in front view, the article after use thereof.

The modus operandi of said article 1 according to the invention is as follows: the consumer presses on sides 8 and 9 of the case 3 with the thumb and fore-finger (arrows F1, FIG. 5), so that the film 16 containing the abrasive particles 17 comes into contact with the film 11 containing the micro-capsules 12. Whilst maintaining the two sides pressed together, he pulls on the emerging end 7 of the tongue 2 (arrow F2, FIG. 4) with the thumb and fore-finger of the other hand, so that, during displacement of said tongue from said case, the friction created between the fixed film 16 and mobile film 11, to which friction is added, in this embodiment, the action of the abrasive particles 17 which penetrate in the film 11, destroys the micro-capsules 12, thus diffusing the perfume that they contain. As shown in FIG. 4, after the tongue has been pulled out, the adhesive film 11 is partly scored and torn under the action of the friction and the abrasive particles.

The consumer, holding the emerging end 7, then takes the tongue 2 releasing the fragrances (represented by arrows F3, FIG. 5) emitted by the perfume near his nose, thus allowing him to appreciate and judge said perfume according to his personal criteria.

Consequently, the article according to the invention is handled cleanly since, on the one hand, the consumer does not have to remove matter directly in order to release said perfume, and, on the other hand, his fingers are not impregnated with perfume since they are in contact either with the outer faces of the sides 8 and 9 or with the upper end 7 of the tongue.

For these reasons, apart from the use of the article for advertising or commercial purposes, it is also appropriate for professionals in the perfume industry. The article may be made of plastics material or an appropriate paper.

What is claimed is:

1. Flat closed case (1) comprising:

two superimposed sheets (8 and 9) and an opening (4) therebetween;

a tongue (2) removably housed in said flat case and having an inner part disposed between said superimposed sheets and an outer part (7) emerging from said flat case through said opening (4);

a least one face (10) of said inner part of the tongue being coated with a fragrant substance releasable by friction of the type constituted by an adhesive film in which are incorporated a plurality of micro-capsules containing said fragrant substance and adapted to be destroyed by pressure; and an inner face (15) of one of said sheets (8,9) being in contact with said one face (10) of said inner part of the tongue, in such a way that when said tongue (2) is pulled away the friction created between said inner face (15) and said one face (10) destroys said micro-capsules and diffuses said fragrant substance.

2. The flat closed case (1) of claim 1 wherein scratching means (16,17) are provided on said inner face (15) of one of said sheets (8,9).

3. The flat closed case (1) of claim 1 wherein said fragrant substance is a perfume.

4. The flat closed case of claim 3 wherein said scratching means are constituted by an adhesive film deposited on said side and containing abrasive particles, with the result that, during the displacement of the tongue out of said case, the abrasive particles tear said microcapsules containing perfume.

5. The flat closed case (1) of claim 1 which is composed of paper.

* * * * *